US005417374A

United States Patent [19]

Kranz et al.

[11] Patent Number: 5,417,374

[45] Date of Patent: May 23, 1995

[54] SYSTEM AND METHOD FOR PRESSURE TREATMENT OF GRANULAR MATERIAL

[75] Inventors: Peter Kranz, Neunkirchen; Franz Goeddecke, Leverkusen; Kunibert Laufs, Aachen; Werner Ewald, Wuelfrath, all of Germany

[73] Assignee: Klockner-Humboldt-Deutz AG, Cologne, Germany

[21] Appl. No.: 111,105

[22] Filed: Aug. 24, 1993

[30] Foreign Application Priority Data

Aug. 24, 1992 [DE] Germany ..... 42 28 058.3

[51] Int. Cl.[6] ..... B02C 23/18; B02C 4/28

[52] U.S. Cl. ..... 241/18; 241/30; 241/224; 241/DIG. 14

[58] Field of Search ..... 241/30, 19, 81, 18, 241/57, 222, 224, 225, 227, 301, DIG. 14

[56] References Cited

U.S. PATENT DOCUMENTS

| | | | |
|---|---|---|---|
| 1,188,323 | 6/1916 | Richardson | 241/224 X |
| 2,442,740 | 6/1948 | Groh | 241/224 |
| 4,592,512 | 6/1986 | Grigel et al. . | |
| 4,651,933 | 3/1987 | Schutte et al. . | |
| 4,703,897 | 11/1987 | Beisner et al. . | |
| 4,726,531 | 2/1988 | Strasser . | |
| 4,728,044 | 2/1988 | Duill et al. . | |
| 4,838,494 | 6/1989 | Jakobs . | |
| 4,840,315 | 6/1989 | Rubin et al. . | |
| 5,005,775 | 4/1991 | Jakobs et al. . | |
| 5,096,131 | 3/1992 | Pazelt et al. | 241/224 |
| 5,114,131 | 5/1992 | Strasser et al. . | |
| 5,165,613 | 11/1992 | Keller . | |

FOREIGN PATENT DOCUMENTS

| | | | |
|---|---|---|---|
| 556960 | 4/1957 | France | 241/224 |
| 71382295 | 1/1972 | Germany . | |
| 218862 | 2/1985 | Germany . | |
| 2708053 | 5/1986 | Germany . | |
| 3790314 | 6/1988 | Germany . | |
| 3806398 | 9/1989 | Germany . | |
| 4006430 | 9/1991 | Germany | 241/224 |
| 4003342 | 6/1992 | Germany . | |
| 361463 | 5/1962 | Switzerland . | |
| 2135211 | 8/1984 | United Kingdom | 241/224 |
| WO91/11320 | 8/1991 | WIPO . | |

*Primary Examiner*—Timothy V. Eley
*Attorney, Agent, or Firm*—Hill, Steadman & Simpson

[57] ABSTRACT

An improved roller press for the high pressure interparticle crushing of a pulverulent material and the method of operating including opposed parallel horizontal crushing rollers forming a high pressure crushing nip between them and forcing air from the material drawn into the nip, a product delivery stack above the nip and an offset lower wall portion above the nip and laterally of the stack forming an exposed sloping surface of the material for the escape of air being pressed out of the material passing into the nip, in one form exposed surfaces are on both sides of the nip and the exposed surfaces may be controlled by adjustable gates to vary the area and slope of the exposed surface, and a subatmospheric pressure may be applied to the material for aiding in the pressing of air from the material drawn into the nip.

18 Claims, 2 Drawing Sheets

SYSTEM AND METHOD FOR PRESSURE TREATMENT OF GRANULAR MATERIAL

BACKGROUND OF THE INVENTION

The invention relates to improvements in a two roller interparticle crushing high pressure roller press and the method of operating for the pressure treatment of granular material.

In the development of roller presses for pressing pulverulent material, a unique method and apparatus have been developed to provide for crushing by a method attaining interparticle crushing. In this interparticle crushing, unusually high nip pressures are utilized of at least 500 kg/cm$^2$ between the rolls and this method is disclosed in U.S. Pat. No. 4,357,287 and German Patent DE-27 08 053, Schoenert and in a subsequent U.S. Pat. No. 4,703,897, Beisner et al. In the novel process of interparticle crushing, the pulverulent material supplied to the nip is crushed by the high pressures and crushing occurs between the particles of material forming incipient cracks within the material so that the material particles can be effectively further disintegrated with minimum energy. The advantage of the interparticle crushing is uniform improved crushing with a substantial reduced outlay of power required.

During operation of a high pressure roller press for interparticle crushing, the pulverulent bulk material is supplied to the nip and seized by the oppositely driven rollers and drawn into the nip by friction. This is a friction between the bulk material particles itself and friction between the bulk material and roller surface. The individual particles of the bulk material that are drawn in are mutually crushed in a product bed with the material compressed between the two roller surfaces with an extremely high pressure which has been known to the art as interparticle crushing and which is disclosed in the aforementioned U.S. and German patents. The products of this pressure treatment are agglomerates or scabs of comminuted bulk material that can be subsequently disintegrated with a minimum of mechanical power outlay.

Simultaneously with the formation of the agglomerates, the air that was originally present in the pulverulent bulk material is expressed from the product bed. It escapes through the material column formed by the bulk material being fed into the nip. As a result of the air escapement, the bulk material is loosened in the draw-in region between the rollers, particularly when the fine grained bulk materials are pressed. The result is that the material draw-in is deteriorated and the escape of air has an adverse effect in the draw-in. As a result, the throughput and the degree of comminution in the nip are lowered.

Efforts have been made to alleviate the problem of the escape of air and the disadvantageous results in that where high proportions of fine grained bulk material are used, the aeration problem is approached by German Published Application 38 06 398. This proposed that the product delivery stack be subdivided and the coarse material and fine material be separately supplied to the nip. By this arrangement, the coarse bulk material is kept so low that the air expressed therefrom can easily escape through the low and coarse pored bulk material.

A disadvantage in this disclosed method is that it can only be employed when the coarse material and the fine material are separated from one another before the pressure treatment. Further, the possibility of the formation of a nonuniform product bed cannot be precluded or occurs due to the separate delivery of coarse material and fine material.

A further disadvantage of known two roller machines is that high wall friction resistances impede the replenishment of the bulk material in the nip due to the lateral pressure of the bulk material supported at the bottom of the roller surfaces against the inside wall of the product delivery stack. This is especially true when the filling level in the product delivery stack is extremely high.

FEATURES OF INVENTION

It is an object of the invention to provide an improved two roller interparticle crushing press wherein the product draw-in behavior is substantially improved and avoids disadvantages of devices heretofore known.

A further object of the invention is to provide an improved two roller interparticle crushing press and method of operating wherein a substantially improved nip draw-in of the material occurs.

A still further object of the invention is to provide an improved two roller high pressure interparticle crushing press with a unique arrangement for improving the escape of air between particles as the particles are fed into the nip.

The invention contemplates broadening of the lower part of the product delivery stack axially over the entire roller length. The bulk material is handled so that it can form an exposed slope or exposed area of material for the escape of air. This broadened area accommodates a free flow of material with control of the slope angle and a clearance is formed between this slope and the walls of the product delivery stack.

Due to the elimination of the wall friction in this zone or region of exposed material as well as the short path length which the expressed air now has to traverse in order to merge from the bulk material, a substantially improved inflow of bulk material to the nip is achieved. The draw-in behavior of the bulk material is noticeably improved.

What is important is that the air emerges laterally from the column of bulk material which is at an angle relative to the downward conveying direction of the bulk material. As a result, the loosening of the bulk material above the nip is greatly avoided and more uniform and improved nip feed-in is accomplished.

In providing an exposed surface at either one or both sides of the nip, the escape of air from the material is accommodated. The exposed area is controlled by controllable flaps in the lower part of the product delivery stack which makes it possible to vary the height of the slope being formed during operation of the machine and thus compensate for changes in the type of bulk material received and such changes have an influence on the in-flow of bulk material to the nip.

In one form, the air emerging from the exposed slope of bulk material can be received and handled by dust removal means. In one form, a vacuum or reduced atmospheric pressure can be applied to the material passing into the nip such as by forming a chamber above the exposed area and pumping out the removed air whereby the removed air can be handled by the dust removal means. The air which exits from the bulk material will be promoted by the reduced pressure above the exposed surface.

Other objects, advantages and features of the invention will become more apparent with the teaching of the principles of the invention in connection with the disclosure of the preferred embodiments thereof in the specification, claims and drawings in which:

DESCRIPTION OF THE PREFERRED EMBODIMENTS

Figure 1:
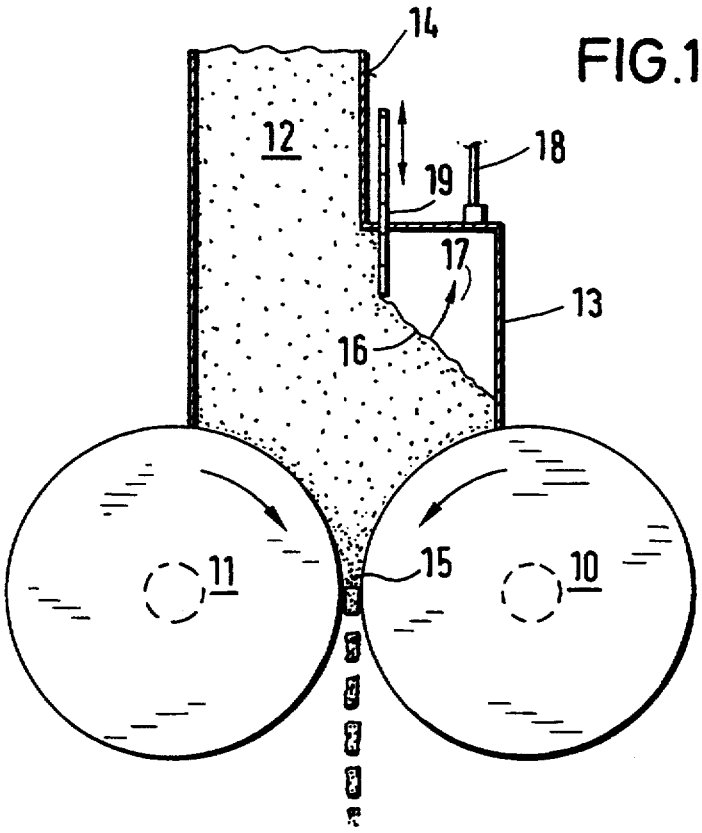
FIG. 1 is a somewhat schematic showing, partially in section, of a product delivery stack feeding material to a two roller press and constructed and operating in accordance with the principles of the present invention.

As illustrated in FIG. 1, a product delivery stack 12 is located above parallel horizontal rollers of a two roller interparticle crushing mechanism. The product delivery stack 12 receives pulverulent stock material from the source and feeds it down into a nip 15 between the rollers 10 and 11.

The product delivery stack 12 is formed between opposed walls and a wall 14 has a lower wall portion 13 which is offset laterally in a direction away from the nip to form an exposed sloping surface 16. Air being expressed from the material passes upwardly through this exposed surface as indicated by the arrowed line 17 and the lower wall portion 13 with an upper wall forms a chamber into which the air flows. The lower wall portion 13 broadens the product delivery stack above the nip so that the resultant stack at the nip is centrally located above the nip 15.

The bulk material at one side of the nip forms the sloping surface 16 through which the air 17 escapes into the chamber above the surface. In the arrangement shown, a section line 18 is connected to the chamber and this leads to a dust removal means (not shown).

The height of the slope 16 above the nip is controlled by a vertically movable flap 19. This flap or slide 19 has means for adjustably controlling its height as indicated by the double arrowed lines. Raising or lowering the flap 19 will change the height of the surface 16 and this can be matched to the different draw-in behaviors of various bulk materials that are fed.

Figure 2:
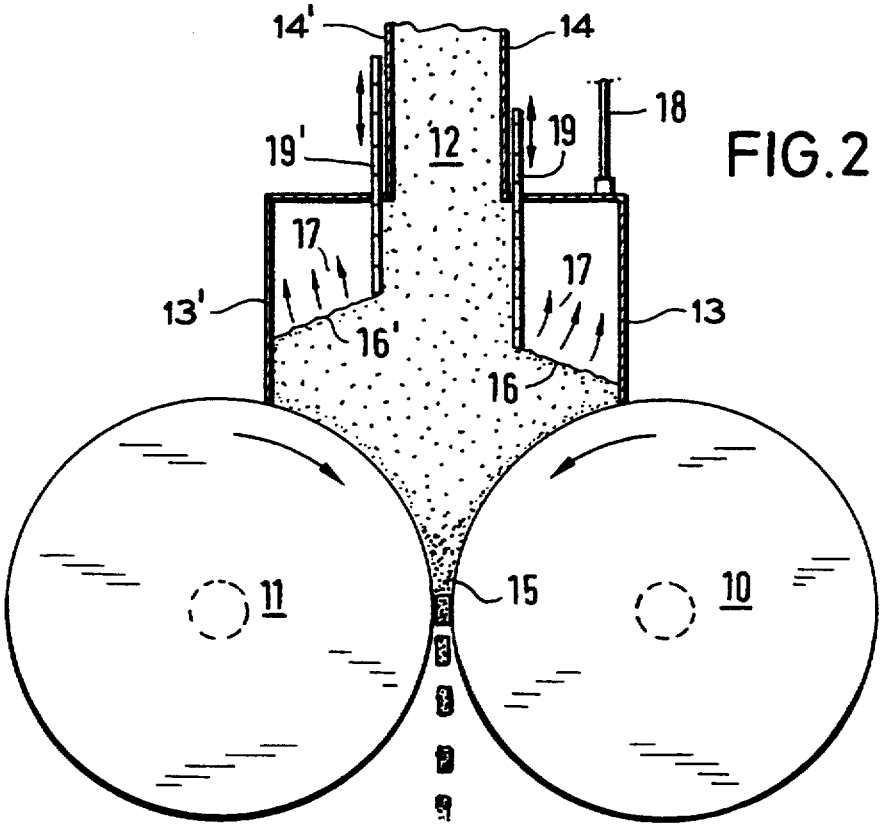
FIG. 2 is an end elevation schematic showing, partially in section, of a modified form of the two roller press with the product stack.

In the apparatus illustrated in FIG. 2, two opposed surfaces are provided. This is accomplished by providing lower wall portions 13 and 13' which are laterally offset from the walls 14 and 14' of the product delivery stack 12. The lower wall portions 13 and 13' are situated so that they are laterally offset an equal distance from the nip 15 to center the resultant feed-in stack to the nip 15. The walls 13 and 13' provide exposed sloping surfaces 16 and 16'. Air expressed from the material flows upwardly as indicated by the arrowed lines 17 and 17'. Slides or flaps 19 and 19' are arranged to be vertically adjustable as indicated by the double arrowed lines. With this arrangement, it is possible to set the height of the flaps or slides 19 and 19' differently so that a different slope can be provided for each of the exposed surfaces 16 and 16'. This allow for differing power consumptions of the driven rollers 10 and 11 and such proclivity can be adjusted during operation to improve the pressing operation of the overall press.

Figure 3:
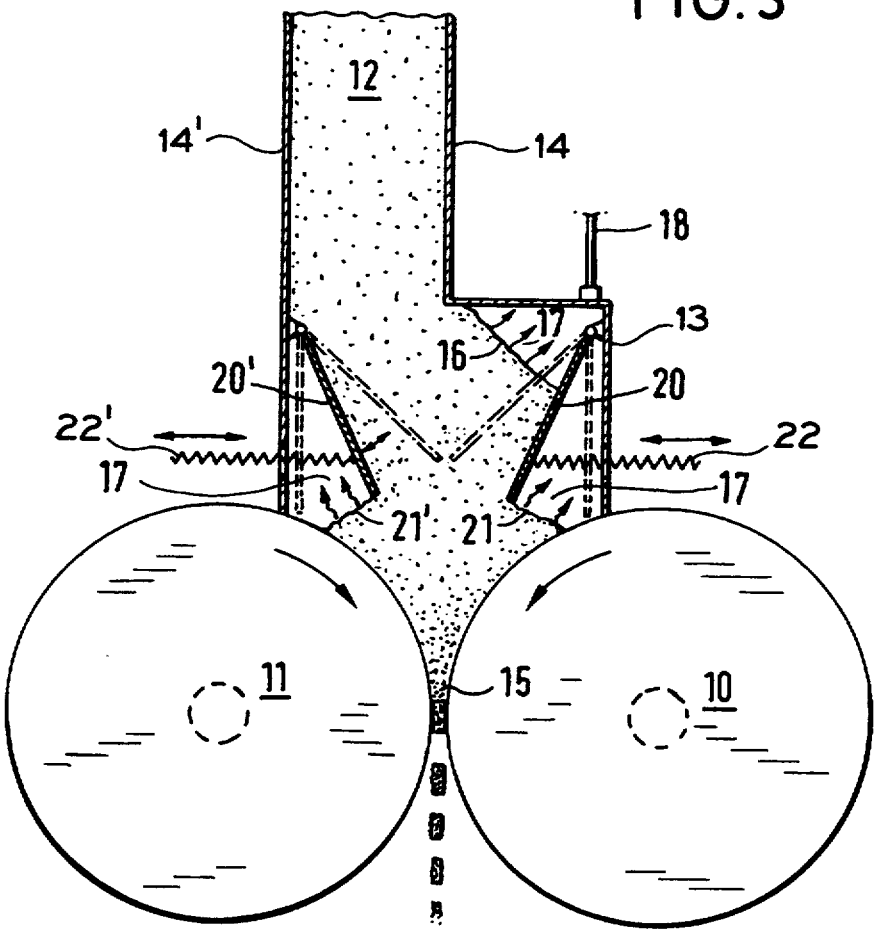
FIG. 3 is another end elevational view shown in schematic form with portions in section.

With reference to FIG. 3, a further arrangement is shown to control the formation of the exposed surface sloping area which accommodates the escape of air. In FIG. 3, the stack 12 is offset laterally and a lower wall portion 13 is laterally offset from the stack so that the feed into the nip from both sides is uniform. That is, above the nip, the wall 14' and the wall 13 are laterally offset an equal distance from the nip 15.

In the area above the nip, two pivotally mounted flaps 20 and 20' are arranged pivoted at their upper edge and pivotally adjustable as indicated by the double arrowed lines to control the slope and height of an exposed surface 21 and 21' of material. The adjustable position of the flaps 20 and 20' are shown by the solid line positions and dotted line positions illustrated in FIG. 3. Adjustment means are indicated schematically by the lines 22 and 22'. Adjustment of the pivotal flaps accomplishes a finely matched regulating element for the optimum adaptation of the draw-in behavior of the bulk material. Since each of the flaps 20 and 20' is individually adjustable, the slopes 21 and 21' can be individually adjusted so that the expression and escape of air can be controlled. A line 18 is again provided for generating subatmospheric air above the surface of the material. As illustrated in FIG. 3, a chamber 17''' is formed above a surface 16. Chambers 17 and 17' are formed by the outer walls on the flaps 20 and 20'. These chambers 17 and 17' may also be connected to a line for the formation of subatmospheric air above the surfaces 21 and 21' and the air drawn off can be passed to a dust removal mechanism. Again, by individually controlling the position of the pivotal flaps 20 and 20' the draw-in behavior and escapement of air can be regulated during operation for improved pressing and draw-in capabilities of the press.

It will be understood that the examples illustrated in FIGS. 1, 2 and 3 can be combined. For example, the product delivery stack of FIG. 2 can be provided with pivotal flaps such as shown in FIG. 3. Similarly, the arrangement of FIG. 3 can be provided with flaps which reciprocate.

In each of the arrangements, it is preferred that the lower stack, that is the material immediately above the nip be balanced on both sides of the rolls for improved draw-in. In the arrangement of FIG. 2, the upper stack 12 can be centrally located and in the arrangement of FIGS. 1 and 3, the upper stacks 12 are laterally offset while the lower portion of the walls are situated so as to center the lower stack with respect to the nip 15.

The interparticle crushing high pressure press can be employed for pressure comminution of granular material and the features can also be utilized for compressing materials such as potassium or rock salts.

Thus, it will be seen that we have provided an improved pressing arrangement which meets the objectives and advantages above set forth and accomplishes higher press output and greater uniformity and is particularly well adapted to interparticle crushing helping eliminate air from between the particles to encourage the incipient formation of cracks in the particles which is an important feature of the interparticle crushing.

We claim as our invention:

1. A roller press for high pressure interparticle crushing of pulverulent material comprising in combination:

opposed parallel horizontal crushing rollers defining a high pressure crushing nip therebetween crushing material and forcing air from the material drawn into the nip;

a product delivery stack above the nip defined by first and second lateral walls extending parallel to the nip providing a complete supply of material to the nip;

and a lower wall portion extending downwardly from the second wall and offset laterally in a direction away from the nip relative to said second wall to form an exposed sloping surface laterally of the second wall of material fed from said stack for the escape of air through said surface being pressed out in the nip.

2. A roller press for high pressure interparticle crushing of a pulverulent material constructed in accordance with claim 1:

including means for regulating the height of said exposed sloping surface of material.

3. A roller press for high pressure interparticle crushing of a pulverulent material constructed in accordance with claim 1:

including a movable flap positioned between the second wall of the delivery stack and said lower wall portion;

and means for positioning said flap for controlling the exposed sloping surface and regulating the sloping surface area for the escape of air through said surface.

4. A roller press for high pressure interparticle crushing of a pulverulent material constructed in accordance with claim 1:

including means for generating a subatmospheric pressure on the surface of said exposed sloping surface for aiding in the escape of air through the surface.

5. A roller press for high pressure interparticle crushing of a pulverulent material constructed in accordance with claim 1:

including a dust removal means connected to an area above said exposed sloping surface for removal of the air and removal of dust from air escaping through said surface.

6. A roller press for high pressure interparticle crushing of a pulverulent material constructed in accordance with claim 1:

wherein the pressure in said nip is in excess of 500 $kg/cm^2$ between the surfaces of the rolls forcing the air out of the material passing into the nip and forming interparticle crushing in the nip.

7. A roller press for high pressure interparticle crushing of a pulverulent material constructed in accordance with claim 1:

including means for adjusting the height of said exposed sloping surface above the nip.

8. A roller press for high pressure interparticle crushing of a pulverulent material constructed in accordance with claim 1:

including means for adjusting the width of said exposed sloping surface.

9. A roller press for high pressure interparticle crushing of a pulverulent material constructed in accordance with claim 1:

including a second lower wall portion laterally offset away from the nip laterally of the first wall to form first and second exposed sloping surfaces at each lateral side of the nip for the escape of air through said surfaces.

10. A roller press for high pressure interparticle crushing of a pulverulent material constructed in accordance with claim 1:

including a flap positioned between said lower wall portion and the second wall of said product delivery stack and vertically adjustable for controlling the height of said exposed sloping surface.

11. A roller press for high pressure interparticle crushing of a pulverulent material constructed in accordance with claim 1:

including a flap positioned between said second wall of the product delivery stack and said lower wall portion and pivotally mounted at its upper edge;

and means for controlling the pivotal position of said flap to control the area of said exposed sloping surface through which the air escapes.

12. A roller press for high pressure interparticle crushing of a pulverulent material constructed in accordance with claim 1:

including means defining an air chamber above said exposed sloping surface for receiving air escaping through the material from the nip.

13. A roller press for high pressure interparticle crushing of a pulverulent material constructed in accordance with claim 12:

including means creating a subatmospheric pressure in said air chamber.

14. The method of high pressure interparticle crushing of a pulverulent material in a high pressure nip formed between opposed horizontal rollers comprising the steps:

feeding the pulverulent material downwardly to a pressing nip in a vertical stack positioned above the nip with the stack supplying a complete supply of material to the nip;

and exposing a sloping surface of material fed from the stack laterally of the nip to provide for the escape of air through said surface at a location below a top of the stack as the air is pressed from the material passing into the nip.

15. The method of high pressure interparticle crushing of a pulverulent material in a high pressure nip formed between opposed horizontal rollers in accordance with the steps of claim 14:

including providing first and second sloping surfaces positioned on opposite sides laterally of the nip for the escape of air through the surfaces.

16. The method of high pressure interparticle crushing of a pulverulent material in a high pressure nip formed between opposed horizontal rollers in accordance with the steps of claim 14:

including adjusting the amount of area of said sloping surface for providing an escape area.

17. The method of high pressure interparticle crushing of a pulverulent material in a high pressure nip formed between opposed horizontal rollers in accordance with the steps of claim 14:

including removing the air from said sloping surface and removing the dust from said air.

18. The method of high pressure interparticle crushing of a pulverulent material in a high pressure nip formed between opposed horizontal rollers in accordance with the steps of claim 14:

including subjecting the sloping surface to a negative atmospheric pressure for aiding in the escape of air through said surface.

* * * * *